US005557394A

United States Patent [19]

Haneda et al.

[11] Patent Number: 5,557,394

[45] Date of Patent: Sep. 17, 1996

[54] COLOR IMAGE FORMING APPARATUS HAVING A TRANSPARENT PHOTORECEPTOR

[75] Inventors: Satoshi Haneda; Masakazu Fukuchi; Tadayoshi Ikeda; Hisayoshi Nagase; Shuta Hamada, all of Hachioji, Japan

[73] Assignee: Konica Corporation, Japan

[21] Appl. No.: 536,447

[22] Filed: Sep. 29, 1995

[30] Foreign Application Priority Data

Oct. 3, 1994 [JP] Japan ..... 6-239006
Feb. 27, 1995 [JP] Japan ..... 7-038591

[51] Int. Cl.[6] ..... G03G 15/01

[52] U.S. Cl. ..... 355/327; 118/645; 355/246

[58] Field of Search ..... 355/326 R, 327, 355/246, 208; 118/645

[56] References Cited

U.S. PATENT DOCUMENTS 2,752,833 7/1956 Jacob .

4,230,405 10/1980 Kurtz .

*Primary Examiner*—R. L. Moses

*Attorney, Agent, or Firm*—Jordan B. Bierman; Bierman and Muserlian

[57] ABSTRACT

A color image forming apparatus such as a printer or a copier. The apparatus includes: a photoreceptor, having a transparent body, for forming a toner image; a charger for charging the photoreceptor; a LED array, accommodated inside the photoreceptor, for imagewisely exposing the photoreceptor with exposure light so as to form a latent image on the photoreceptor; a developer for developing the latent image with toner so as to form a toner image on the photoreceptor; in which a process of forming the toner image is repeated for plural times so that plural toner images are superimposed to from a composite toner image; a transferor for transferring the composite toner image onto a recording medium; and a photodetector, accommodated inside the photoreceptor, for detecting light from the photoreceptor in which the light has a high transmission factor for the photoreceptor.

26 Claims, 13 Drawing Sheets

SPECTRAL REFLECTION FACTOR OF COLOR TONER

FIG. 13 ( a )
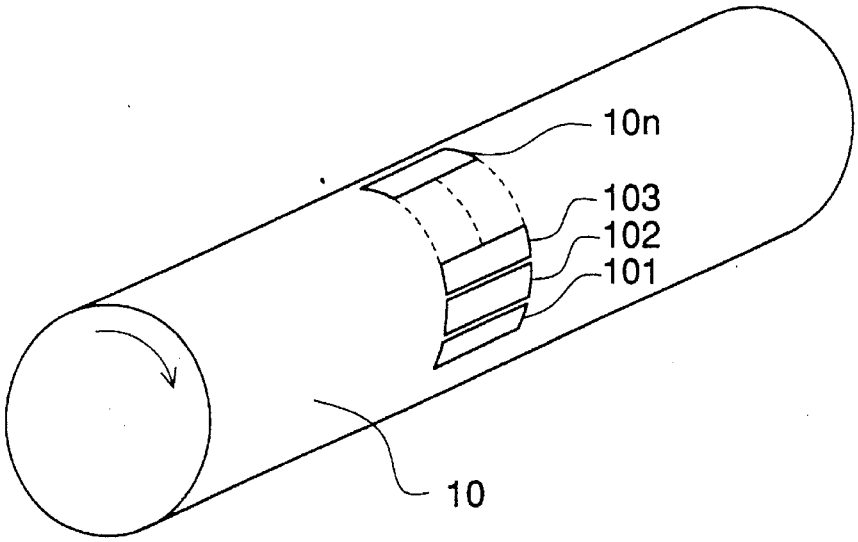
FIG. 13 ( b )
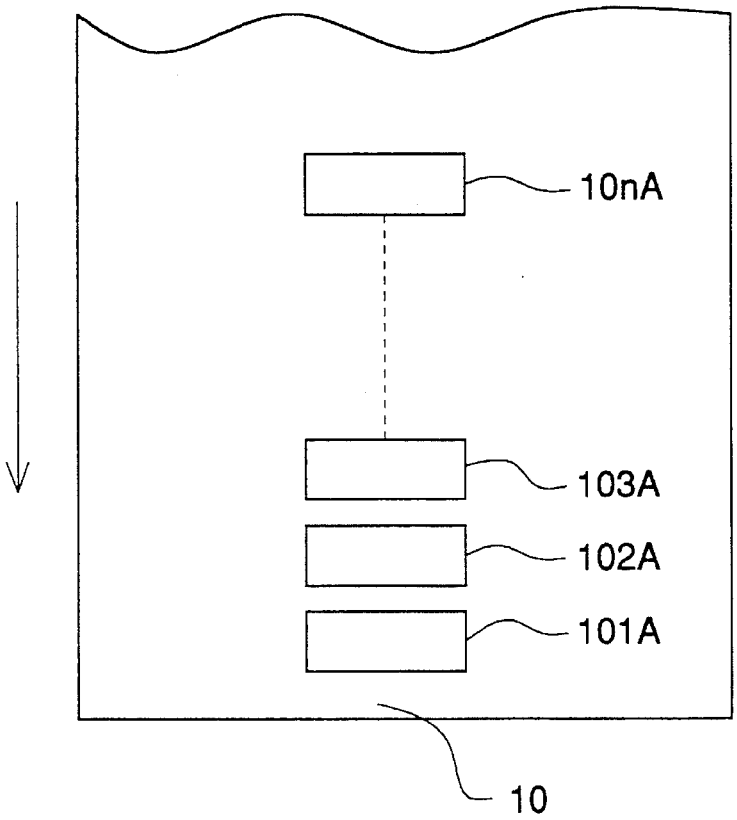

COLOR IMAGE FORMING APPARATUS HAVING A TRANSPARENT PHOTORECEPTOR

BACKGROUND OF THE INVENTION

The present invention relates to a color image forming apparatus of an electrophotographic system having a drum-shaped photoreceptor provided therein with a plurality of imagewise exposure means, wherein a plurality of developing units are arranged around the circumferential surface of the photoreceptor so that toner images are formed and superposed while the photoreceptor makes one turn.

There have been known the following apparatuses as a method of forming a multi-color image:

an apparatus (A) in which photoreceptor drums, charging devices and developing devices each corresponding in number to colors necessary for forming the multi-color image are provided, and a mono-color toner image formed on each photoreceptor drum is superimposed one after another on an intermediate transfer member so as to form a color image, an apparatus (B) in which a single photoreceptor drum makes plural turns so that the charging, imagewise exposure and developing processes for each color are repeated so as to form a color image, and an apparatus (C) in which the charging, imagewise exposure and developing processes are conducted for each color sequentially while a single photoreceptor drum makes one turn so as to form a color image.

However, the apparatus (A) has a drawback that a size of the apparatus become too large because the plural photoreceptor drums and the intermediate transfer members are required. The dimensions of the apparatus (B) can be made relatively smaller because the required number of each of the charging means, imagewise exposure means and photoreceptor is only a single, however, the apparatus (B) has a limitation that the size of a formed image is limited not to be larger than the area of the circumferential surface of the photoreceptor drum.

Apparatus (C) makes it possible to form images at high speed. In the apparatus (C), however, it is necessary to arrange a plurality of charging units, imagewise exposure means and developing units within the circumference of a photoreceptor, and it is also necessary to make a space between the imagewise exposure means and the developing unit large to avoid a fear that an optics system is contaminated by toner leaking from the developing unit that is close to the optics system and thereby image quality is deteriorated. Therefore, the photoreceptor diameter is inevitably large, resulting in a large apparatus, which is a contradiction.

For the purpose of preventing the disadvantages of the apparatus (C) mentioned above, there has been proposed an apparatus wherein a base substance of an photoreceptor is a transparent material which houses a plurality of imagewise exposure means and imagewise exposure is made on a photoreceptor layer on which images are formed through the aforesaid base substance (for example, Japanese Patent Publication Open to Public Inspection No. 307307/1993 (hereinafter referred to as Japanese Patent O.P.I Publication).

An apparatus based on the aforementioned proposal is one wherein there is provided a supporting member in which imagewise exposure means are arranged inside an photoreceptor, and exposure is conducted from the inside of the photoreceptor. In the conventional methods, there is one for obtaining control information of the image forming apparatus, such as toner density, gradation attribute, exposure amount compensation, jam detection of a transfer material, and reference position detection, by detecting a density of toner image formed on the photoreceptor. However, in the conventional methods, irradiation of light and detection of its reflection are conducted by a light detection means, which is provided outside the photoreceptor. In these methods, the light detection means is provided on the same side of a developer in relation to the photoreceptor; therefore, detection precision of the light detection means is deteriorated by the toner splash so that precise control of image forming apparatus can not be performed.

SUMMARY OF THE INVENTION

An object of the invention is to solve the aforementioned problems and to provide a color image forming apparatus capable of obtaining sharp images by attaining that (1) the aforementioned photodetecting means detects accurately through the photoreceptor and (2) the aforementioned photodetecting means can be installed at higher accuracy together with an optics system of an imagewise exposure means.

The object (1) of the invention mentioned above can be attained by a color image forming apparatus for forming toner images on the photoreceptor by repeating charging conducted by a charging means, imagewise exposure conducted by an imagewise exposure means and development conducted by a developing means, and for transferring the toner images onto a transfer material, wherein the imagewise exposure means and the photodetecting means are provided inside the photoreceptor and light used for the photodetecting means has a high transmission factor for the photoreceptor.

The object (2) of the invention mentioned above can be attained by a color image forming apparatus for forming toner images on the photoreceptor by repeating charging conducted by a charging means, imagewise exposure conducted by an imagewise exposure means and development conducted by a developing means, and for transferring the toner images onto a transfer material, wherein the imagewise exposure means and the photodetecting means are provided inside the photoreceptor and the imagewise exposure means and the photodetecting means are installed on the same supporting member.

Further, in the color image forming apparatus, a wavelength of light used for the photodetecting means is determined to be 750 nm or more, black toner forming the toner images mentioned above is one having a high transmission factor for the wavelength of 750 nm or more, and light-absorbing member absorbing exposure light mentioned above and an electrode member are provided on the outer circumferential surface of an photoreceptor facing the photodetecting means, which is a preferred embodiment of the invention.

Further, in the color image forming apparatus, a process cartridge including the photoreceptor is detachable, and the photodetecting means mentioned above has functions as a toner detection means on the photoreceptor, a detection means for a transfer material, a reference position detection means of the photoreceptor and a light amount detection means of the imagewise exposure or an exposure means for neutralizing, which is a preferred embodiment of the invention.

DETAILED DESCRIPTION OF THE INVENTION

Figure 1:
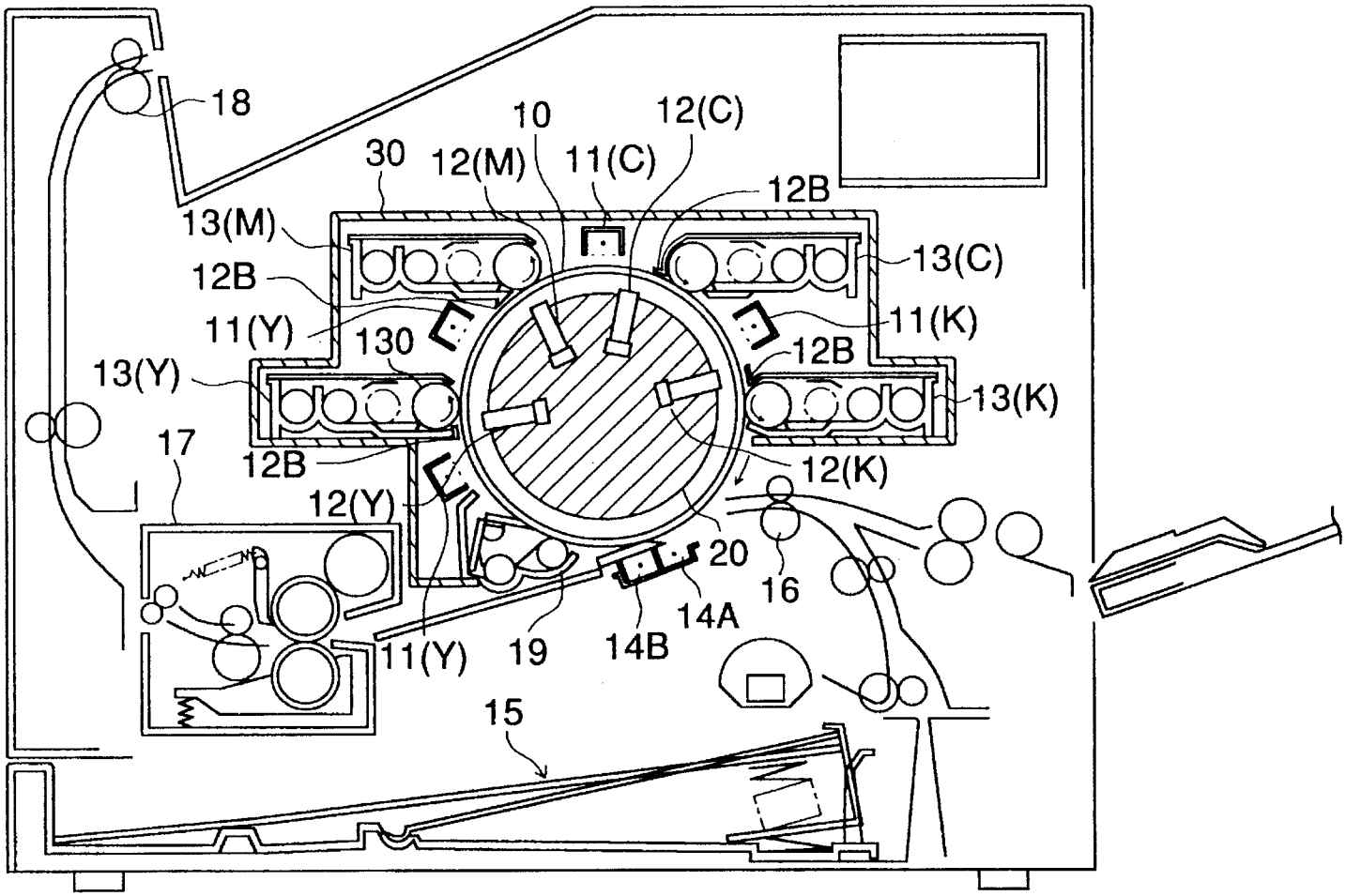
FIG. 1 is a sectional view showing a basic constitution of a color image forming apparatus of the invention.

Before explaining each example of the invention, the constitution of a color image forming apparatus that is common to all of the inventions will be explained as follows, referring to FIGS. 1 and 2. The numeral 10 is a drum-shaped image-forming member, that is, a photoreceptor drum, and it is made in such a manner that an outer circumferential surface of a cylindrical base member made of an optical glass or a transparent member such as transparent acrylic resins is coated with a transparent conductive layer, an organic photoconductor layer (OPC) and α—Si photoconductive layer.

A flange 10A at one end of the photoreceptor drum 10 is supported by a guide pin 30P with a bearing in a cartridge 30 which will be explained later. An inner circumferential surface of a flange 10B at the other end of the photoreceptor drum 10 is fit with a plurality of guide roller 40R provided on a base plate 40 of the apparatus body. A gear 10 on an outer circumferential surface of a flange 10B is engaged with a driving gear 40G so that the photoreceptor drum 10 is rotated clockwise by the driving force through the driving gear 40G on a condition that the above-mentioned transparent conductive layer is grounded.

The numeral 11 represents a scorotron charging unit that is a charging means which charges electrically through both a grid kept at a predetermined potential level against the organic photoconductor layer of the photoreceptor drum 10 and corona discharging by a corona wire, whereby the photoreceptor drum 10 is given an uniform potential.

Numeral 12 represents an optical exposure system that is an imagewise exposure means composed of light-emitting elements such as LED, EL and PL aligned in the axial direction of the photoreceptor drum 10 and image-forming elements such as SELFOC lenses. Image signals for each color read by a separate image reading device are taken out successively from a memory and are inputted as electric signals into each of the optical exposure systems 12.

The numeral 21 is a photodetector that is a photodetecting means composed of a light-emitting element such as an LED and a light-intercepting element such as a photodiode, and it is used for detecting density of a test patch image explained later and for detecting a reference position.

Although a light-emitting wavelength of a light-emitting element of the aforementioned optics exposure system 12 and photodetector 21 used in the present example is not fixed, those in the range of 500–1000 nm are usually used.

Each of the optical exposure systems 12 and photoreceptor 12 are attached on a cylindrical pillar-like supporting member 20 which is guided by a guide pin 40P1 and fixed on the base plate 40 of the apparatus body, whereby the optical exposure systems are accommodated inside of the photoreceptor drum 10. The optics exposure system 12 may also be composed of a combination of the aforementioned light-emitting element and light-shutter members such as LCD, LISA and PLZT and of an image forming element such as a SELFOC lens The numerals 13Y to 13K are developing devices containing respectively a corresponding one of developing agents of yellow (Y), magenta (M), cyan (C) and K (black), and each developing device is equipped with a developing sleeve 130 which locates to keep a predetermined gap distance to a circumferential surface of the photoreceptor drum 10 and rotates in the same direction as that of the photoreceptor drum 10.

Each developing device 13 conducts a reversal development on a non-contact condition under an application of a developing bias voltage for an electrostatic latent image which has been formed on the photoreceptor drum 10 through a charging process by the charging device 11 and an imagewise exposure process by the optical exposure system 12.

Next, a color image forming process in the apparatus of the present invention will be explained.

An image on a document read by an image sensor in an image reading device which is separate from the present apparatus, or an image compiled by a computer is stored in a memory temporarily as image signals of each color of Y, M, C and K.

At the start of an image recording, a photoreceptor driving motor starts rotating so as to rotate clockwise the photoreceptor drum 10 and, simultaneously, the scorotron charging unit 11 (Y) starts providing an electric potential to the photoreceptor drum 10 through its charging action.

After a photoconductive layer of the photoreceptor drum 10 has been provided with the electric potential, an imagewise exposure is started by electric signals corresponding to the first color signals, that is, yellow (Y) image signals in the optical exposure system 12 (Y), and an electrostatic latent image corresponding to a yellow (Y) image of the document image is formed on a light-sensitive layer on the surface of the drum with the rotary scanning of the drum.

The latent image is subjected to the reversal development conducted by a developing unit 13 (Y) under the non-contact condition of developing agent on a developing sleeve, and a yellow (Y) toner image is formed on the photoreceptor drum 10 as the photoreceptor drum 10 rotates.

Then, photoreceptor drum 10 is further provided with an electric potential on the yellow (Y) toner image formed thereon through a charging operation of the charging unit 11 (M), then an imagewise exposure is conducted by electric signals corresponding to the second color signals, that is, magenta (M) image signals, in the optical exposure system 12 (M), and a magenta (M) toner image is superimposed on the aforementioned yellow (Y) toner image through the non-contact type reversal development by the developing unit 13 (M).

In the same process as in the foregoing, a cyan (C) toner image corresponding to the third color signals is formed and superimposed by the charging unit 11 (C), optical exposure system 12 (C) and developing unit 13 (C), and, then, a black (K) toner image corresponding to the fourth color signals is formed and superimposed finally in succession by the charging unit 11 (K), the optical exposure system 12 (K) and the developing unit 13 (K), whereby a color toner image is formed on the circumferential surface of the photoreceptor drum 10 within its one rotation.

Figure 12:
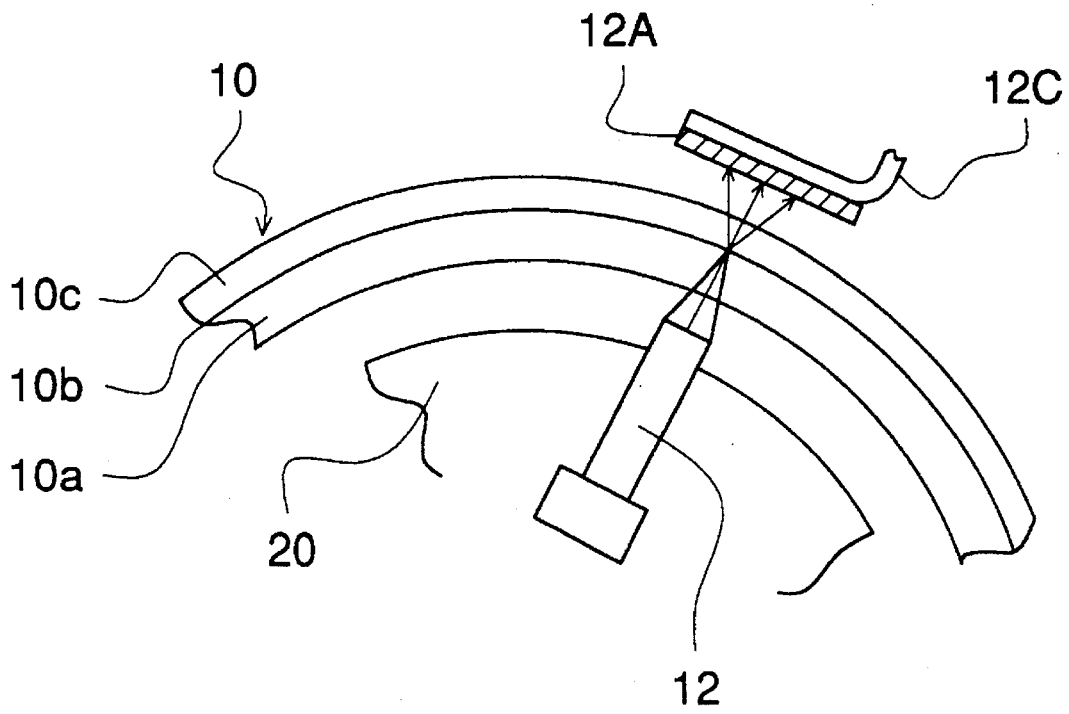
FIG. 12 an enlarged sectional view showing an example of an exposure portion in the present example FIG. 13(*a*) represents a perspective view and FIG. 13(*b*) represents a development elevation showing a test patch image for gradation correction use.

Exposure to photoconductor layer 10*c* (shown in FIG. 12) of photoreceptor drum 10 is conducted by the optical exposure systems mentioned above through the transparent base member from the inside of the drum. Therefore, the imagewise exposures corresponding to the second, third and fourth color signals can be conducted respectively under the state that they are not transmitted through the toner images formed previously, thus it is possible to form an electrostatic latent image equivalent in quality to that corresponding to the first color signals. Incidentally, with regard to the stabilization of a temperature and the prevention of a temperature rise in the photoreceptor drum 10 against a heat generated by the optical exposure systems 12, it is possible to attain them to a certain level, by taking the following steps. A material having an excellent thermal conductivity is used for the supporting member 20. When the temperature is low, heater 201 is used, while it is high, heat is released to the outside through heat pipe 202. In the case of developing operation conducted by each developing unit, developing bias in which DC is added or AC is further added is applied on each developing sleeve 10, then the jumping development with one-component or two-component developing agent contained in the developing unit is conducted, and the non-contact type reversal development is carried out for the photoreceptor drum 10 having a grounded transparent conductive layer 10*b*.

A color toner image thus formed on the peripheral surface of the photoreceptor drum 10 is transferred in a transfer device 14A onto a transfer sheet representing a transfer material which is fed out from sheet feed cassette 15 and is conveyed synchronously with the toner image on the photoreceptor drum 10 by the drive of the timing roller 16.

Transfer sheet onto which the toner image has been transferred is electrically discharged by the discharger 14*b*, so that the transfer sheet P is separated from the peripheral surface of the drum. In a fixing unit 17, the toner image is fused and fixed onto the transfer sheet. After that, the transfer sheet is discharged to a paper discharge tray on a upper portion of the apparatus through a paper discharge rollers 18.

On the other hand, after the transfer sheet has been separated from the photoreceptor drum 10, the residual toner on the surface of the photoreceptor drum 10 is removed and the surface of the photoreceptor drum 10 is cleaned in a cleaning device 19. In this way, the toner image formation is continued for a document image, or alternatively the toner image formation is once stopped and the apparatus advances to a next toner image formation for a new document image.

The photoreceptor drum 10, the charger 11, developing unit 13 and cleaning unit 19 are integrally accommodated in the cartridge 30 and they can be mounted on or dismounted from the apparatus main body without giving load or shock to the imagewise exposure means, leaving supporting member 20 having optical exposure system 12 in the apparatus main body. The above structure in which the support member 20 is left in the apparatus body in the operation for attachment and detachment has an advantage that the heater 201, heat pipe 202, lead 203 for acting LED, and optical exposure system 12 and photodetector 21 can be affixed to the support member 20 even if the photoreceptor drum is rotated, attached or detached. Further, it is possible to use the above structure for determining the axis of the photoreceptor drum 10 as mentioned below.

Figure 3:
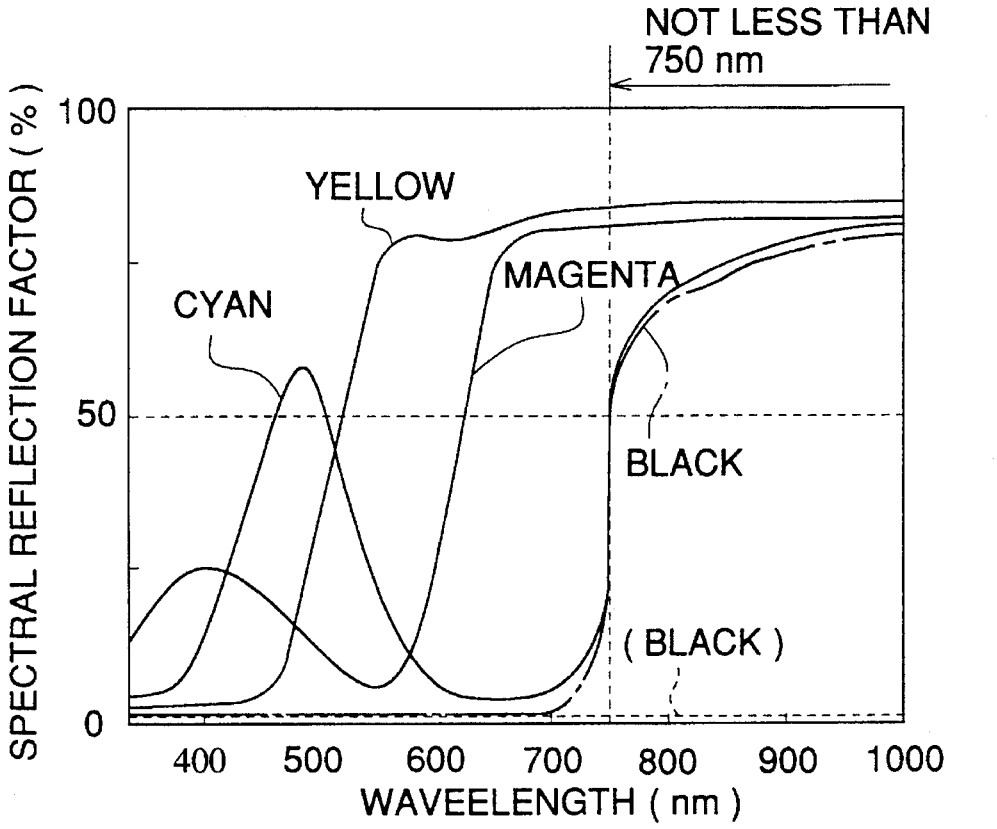
FIG. 3 is a graph showing spectral reflectance of toner.

Before explaining examples of the invention, there will be explained as follows spectral reflectances of toners such as yellow toner, magenta toner and cyan toner. Spectral reflectance of toner for ordinary color use has characteristics as shown with solid lines in FIG. 3. This spectral reflectance is one obtained by measuring the reflectance of the one wherein each toner equivalent in quantity almost to a layer is spread over on a white base plate. The low reflectance means that absorption rate in the toner layer for the light used in measurement is great, while The high reflectance means that the transmission factor of the toner itself for the light used in measurement is great, It is found, from the characteristics shown in FIG. 3, that reflectances of magenta toner, yellow toner and cyan toner are 50% or more for exposure light having a wavelength of 750 nm or more. Further, in the case of black toner containing carbon black, the reflectance is not more than 30% even for light with a wavelength of 1750 nm or more as shown with dashed lines. However, the reflectance curve of black toner obtained by mixing coloring agents for magenta, yellow and cyan toners (namely, obtained from a blend of dyes and pigments) shows one indicated with one-dot chain lines and has a reflectance of 50% or more even for light with a wavelength of 750 nm or more.

In the invention, a light-emitting element of an imagewise exposure means and a photodetecting means which emits light with a wavelength having high transmission factor for an photoreceptor and for toner images formed on the photoreceptor is preferably selected. In addition, black toner obtained by mixing coloring agents for magenta, yellow and cyan toners is used. In the color image forming apparatus of the invention, therefore, a light-emitting element for optics exposure system 12 and photodetector 21 which emits light with a wavelength of 750 nm or more is used, and black toner showing the reflectance of 50% or more for the wavelength of 750 nm or more is used. Therefore, black images may be formed either in the beginning or in any sequence.

Further, it is preferable that a transmission factor of the photoreceptor itself is not less than 70% in relation to the used light. By that manner, light is transmitted preferably and the reflection of the light is detected.

Further, a light-absorbing member is provided on the surface of an photoreceptor facing an imagewise exposure means and a photodetecting means, which will be explained later. Due to such constitution and image forming process, it is possible to avoid occurrence of unnecessary light caused by reflection in the apparatus of both detection light and imagewise exposure light transmitted through photoreceptor drum 10 and toner images. As a result, it is possible to improve accuracy of density detection and it is possible to form clear and sharp latent images by only imagewise exposure because of no unnecessary light.

In the invention, a photodetecting means is housed in an photoreceptor and thereby there is no contamination caused by toner, and both the photodetecting means and an imagewise exposure means are provided on the same plate, and thereby high positional accuracy can be kept, resulting in stable and highly accurate detecting performance.

(EXAMPLE 1)

Figure 4:
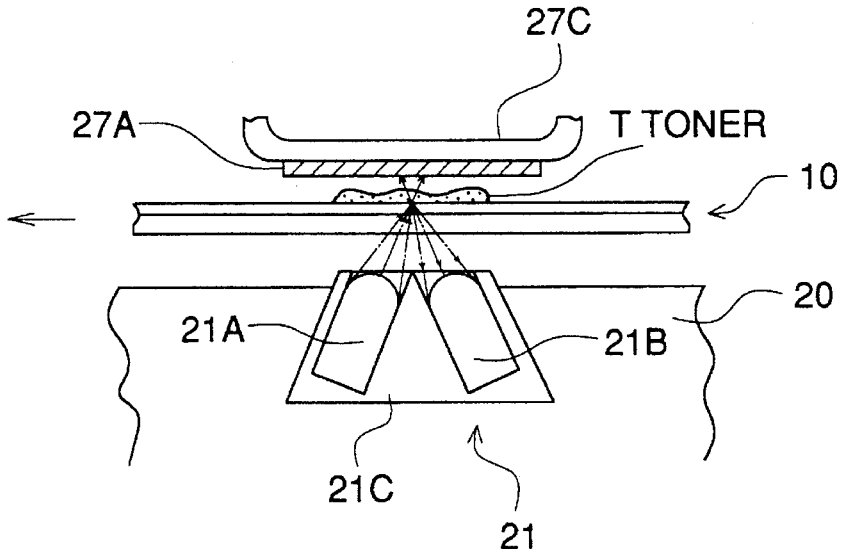
FIG. 4 is an enlarged sectional view showing an example of a photodetecting portion in the first example.
Figure 5:
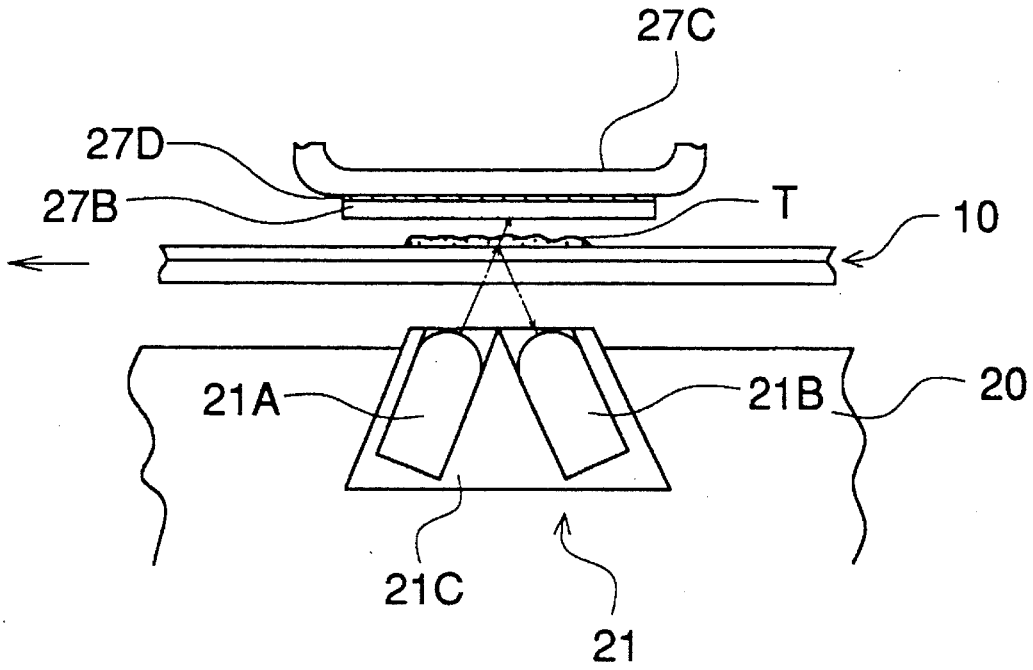
FIG. 5 is an enlarged sectional view showing another example of a photodetecting portion in the first example.
Figure 6:
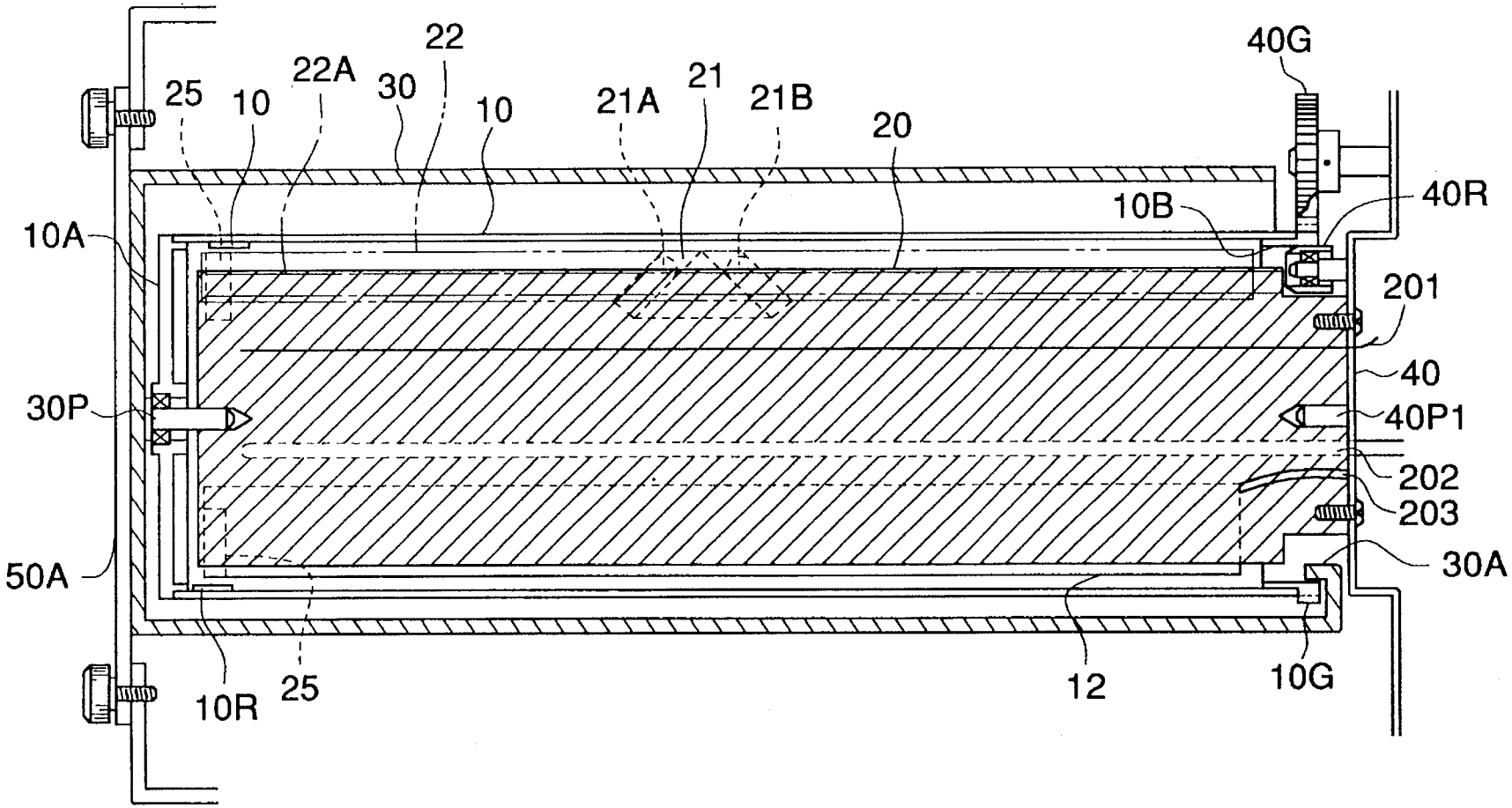
FIG. 6 is a sectional view showing an arrangement of a photodetector in the first example.

FIG. 4 is an enlarged sectional view of a photodetector that is a photodetecting means of an apparatus in the invention. In the figure, 21 represents a photodetector which is a photodetecting means composed of light-emitting element 21A such as LEDs and of light-intercepting element 21B such as photodiodes and phototransistors. The light-emitting element 21A and the light-intercepting element 21B which are arranged in parallel with the moving direction of photoreceptor 10 as shown in FIG. 6 are installed on upper supporting member 20 attached on case 21C so that the light-emitting element can emit the detecting light that is light for detection projected on a toner layer on photoreceptor drum 10 in the direction of about 40° from a perpendicular line to the toner layer and the light-intercepting element can intercept reflection light of detecting light reflected irregularly on the toner layer in the opposite direction of about 40°. Incidentally, the light-emitting element 21A and the light-intercepting element 21B may be installed in the direction of a rotary shaft of photoreceptor drum 10, or the light-intercepting element 21B may be installed perpendicularly to the toner layer.

The symbol 27A is a light-absorbing member provided on the surface (outer side) of photoreceptor drum 10 facing the aforementioned photodetector 21, and it is made of a black sheet of paper absorbing detecting light. For example, it is provided on supporting plate 27C affixed on a casing of developing unit 13 and it absorbs detecting light transmitted through photoreceptor drum 10 and the toner layer. Owing to this, the exposure light is prevented from becoming unnecessary light and from scattering in the vicinity of the optics scanning system 12.

Even on the surface (outer side) of photoreceptor drum 10 facing the optics exposure system 12, there is provided light-absorbing member 12A on supporting plate 12C affixed on a casing of developing unit 13 and it absorbs exposure light transmitted through photoreceptor drum 10 and the toner layer. Owing to this, the exposure light is prevented from becoming unnecessary light and from scattering in the vicinity of the optics scanning system 12.

With this photodetector 21, it is possible to conduct density detection for toner images on an photoreceptor stated later and to conduct reference position detection for the photoreceptor.

(EXAMPLE 2)

Figure 2:
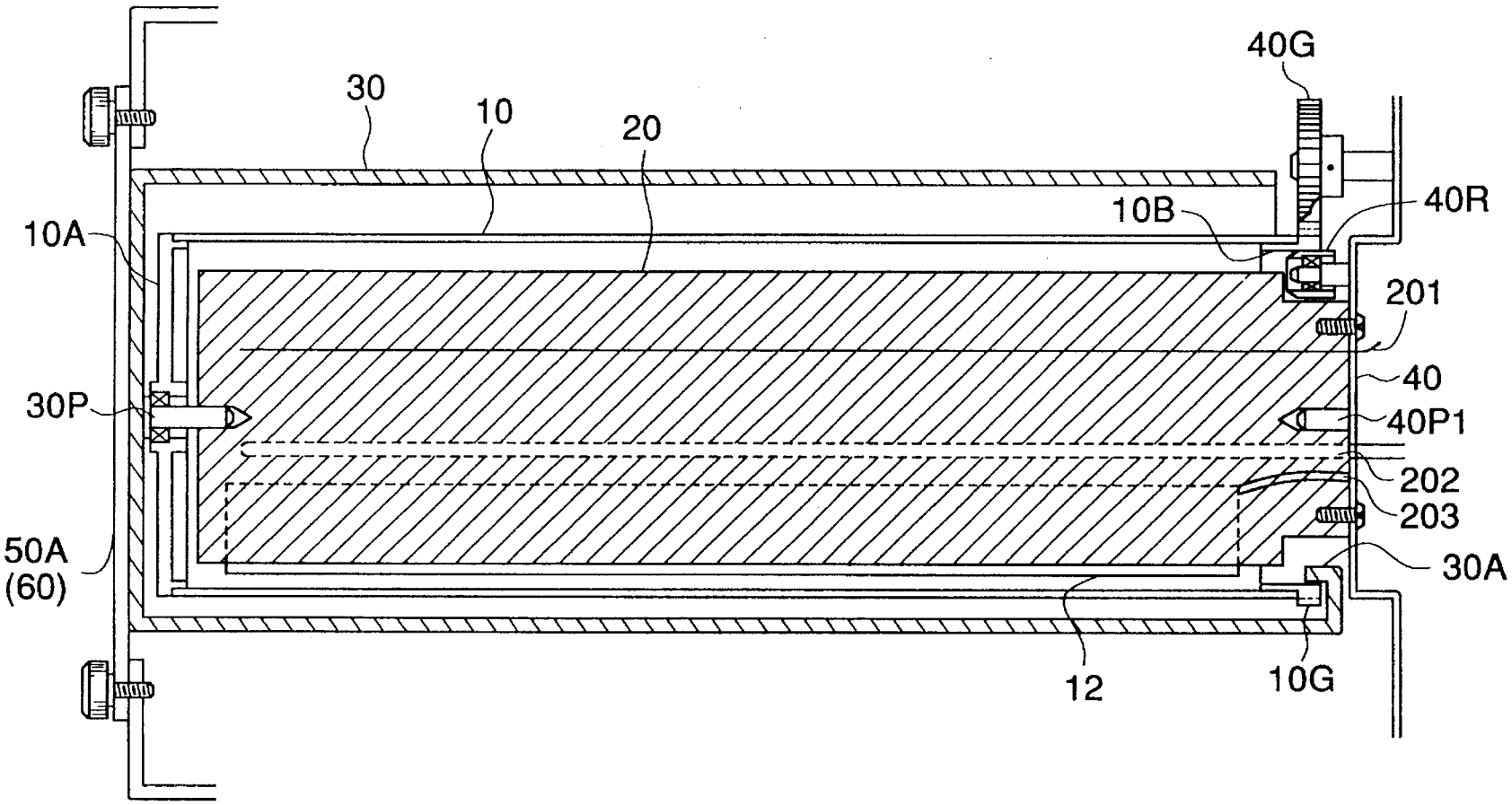
FIG. 2 is a sectional view showing primary portions of a supporting member in FIG. 1.

The basic constitution of Example 2 is the same as that of Example 1 shown in FIGS. 1, 2 and 4. In Example 2, however, there is provided, at the position of light-absorbing member 27A of Example 1, electrode member 27B which is attached on supporting plate 27C through insulating member 27D. On this electrode member 27B, there is impressed a voltage of −1000 V, for example, which is the same in polarity as that of toner charging and is greater in absolute value than charging voltage (−750 V) of photoreceptor drum 10 or a voltage (−650 V) to be impressed on developing sleeve 130. The surface of the electrode member 27B facing the photoreceptor drum 10 a rough surface which has been subjected to black processing or black coating. Owing to this, detecting light transmitted through photoreceptor drum 10 is absorbed in the same manner as in Example 1, and thereby scattering of unnecessary light in photodetecting is reduced greatly and toner in a photodetecting area is electrically held by the voltage impressed on the electrode member 27B, thus, contamination caused by toner and toner scattering can be prevented.

(EXAMPLE 3)

The basic constitution of Example 3 is the same as that of Example 1 or Example 2 shown in FIGS. 1–5. In Example 3, however, both photodetector 21 (photodetecting means) and optics exposure system 12 (imagewise exposure means) are installed on the same supporting member 20 (supporting member), and a process cartridge including an photoreceptor is capable of being mounted on and dismounted from the apparatus main body.

Figure 7:
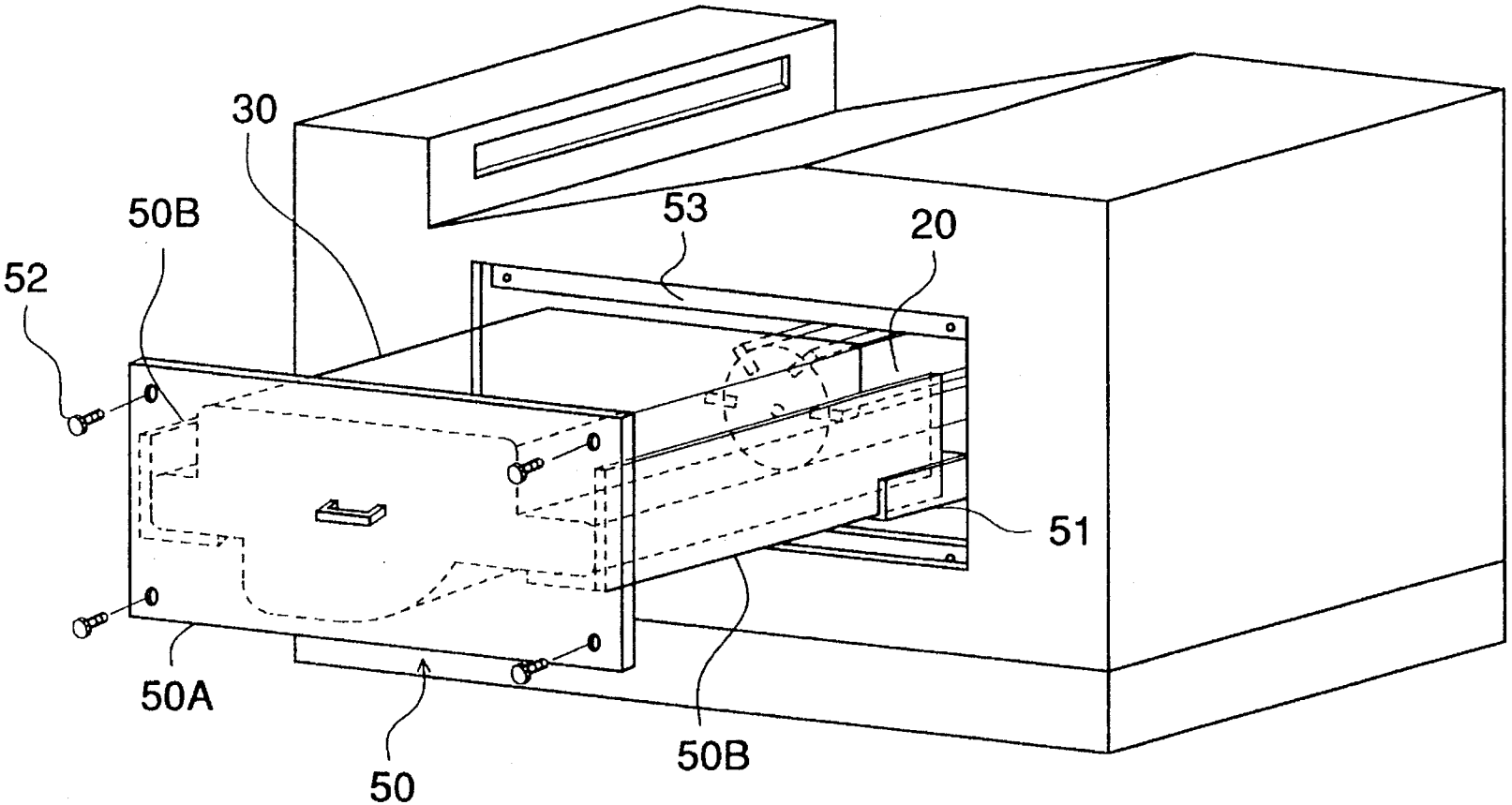
FIG. 7 is a perspective view showing how a cartridge is mounted or dismounted in the third example.

FIG. 7 is a perspective view showing how the cartridge is mounted and dismounted.

The aforementioned cartridge 30 is loaded in carriage 50 that is provided on the side of the apparatus main body in a manner that the carriage can be inserted in and drawn out of the apparatus main body as shown in FIGS. 7 and 2, so that the cartridge can be inserted in and drawn out of the inside portion of the apparatus.

The aforementioned carriage 50 which is composed of side plate 50A and supporting stand 50B is slid horizontally along guide rail 51 located inside the main body, while carrying the cartridge 30 that is positioned correctly on the carriage.

When inserting the carriage 50 into the apparatus, guide pin 30P that supports photoreceptor drum 10 in the cartridge 30 is engaged with supporting member 20 on which the photodetector 21 and optics exposure system 12 are attached, and almost simultaneously, flange 10B is engaged externally with guide roller 40R located on the side of the base plate 40 and then the side plate 50A is brought into closer contact with stopper portion 53 on the apparatus main body to be affixed with set screw 52. Thereby, an axis of the photoreceptor drum 10 and central position in the axial direction thereof for the image forming section are determined.

When the carriage 50 is slid out of the apparatus, the carriage is stopped at the position where the photoreceptor drum 10 is separated from the supporting member 20 on which the optics exposure system 12 and photodetector 21 are attached, to be supported by the guide rail 51.

The flange 10B of the photoreceptor drum 10 that is disengaged from the guide roller 40R provided on the base plate 40 when the carriage 50 is drawn out is still supported by several folded portions 30A formed solidly with the cartridge 30, thus, the flange can maintain its axial position that is almost the same as that for insertion thereof. Therefore, even when the carriage 50 is inserted again, the flange 10B can be engaged easily with the guide roller 40R externally, thus, the photoreceptor drum 10 can be set at its regular axial position.

Figure 8:
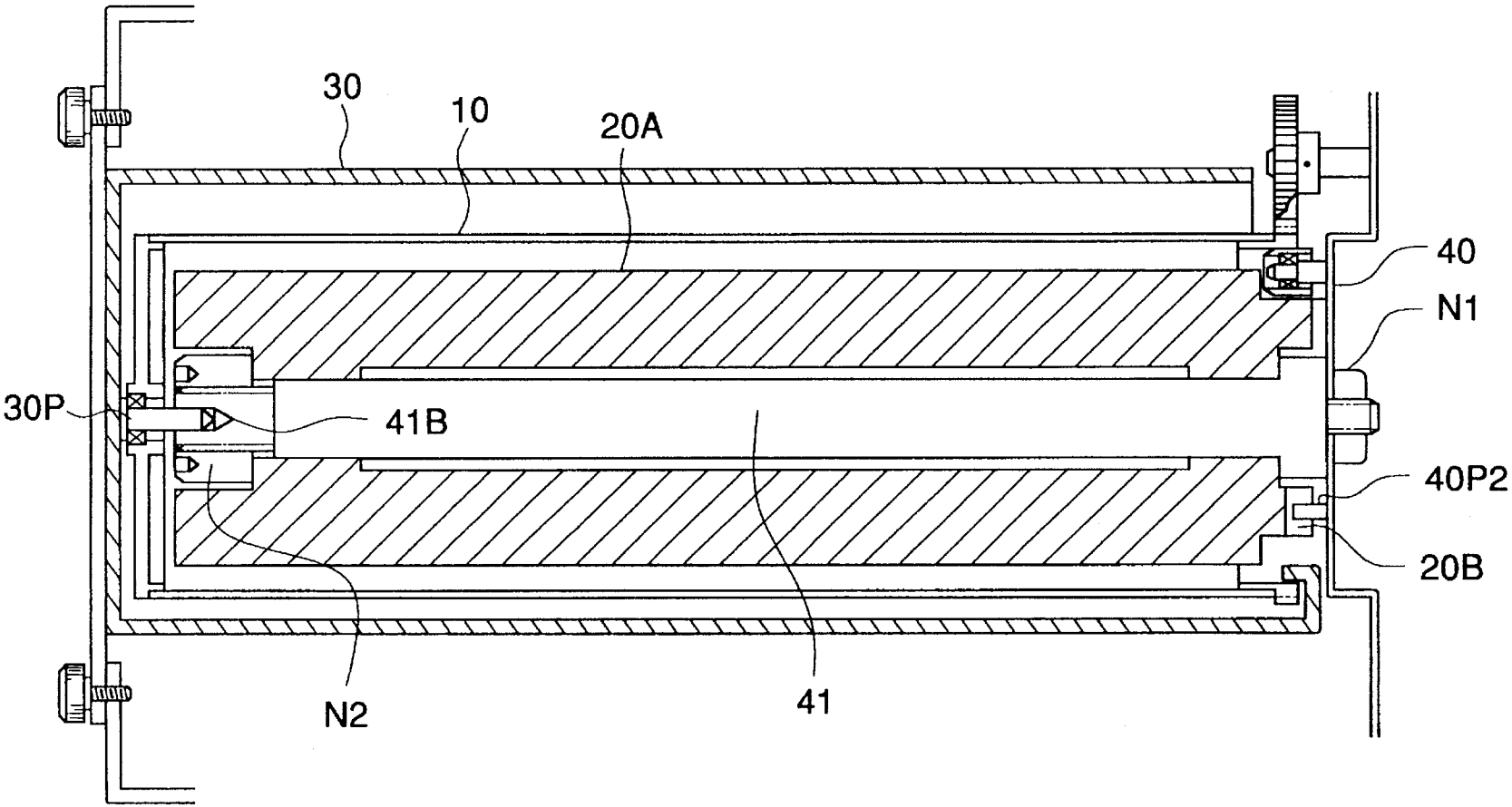
FIG. 8 is a sectional view showing how a cartridge is mounted or dismounted in the third example.

Further, FIG. 8 shows an example wherein both the photodetector 21 and optics exposure system 12 can be removed from the apparatus main body while they are supported solidly on supporting member 20A. The supporting member 20A is engaged with bolt-shaped pillar 41 affixed firmly by nut N1 on the base plate 40, then slot 20B on the supporting member 20A is engaged with reference pin 40P2 on the base plate 40 so that the supporting member is regulated in its rotational direction and then it is affixed solidly by tightening nut N1.

On the other hand, the guide pin 30P that supports flange 10A of the photoreceptor drum 10 is engaged with engagement hole 41B located at the tip of the pillar 41 so that the axis of the photoreceptor drum 10 may agree with that of the supporting member 20A.

After the cartridge 30 has been drawn out, it is possible to take out, by simply removing the nut N1, the supporting member 20A together with each optics exposure system 12 staying on the supporting member from the apparatus, and thereby to conduct maintenance such as cleaning and replacement efficiently. In the constitution in this case, a lead wire of a heater and that of optics system 12 are connected through a connector.

Since the photoreceptor drum 10 shown in the example houses therein the photodetector 21 and optics exposure system 12, a plurality of the aforementioned charging units 11 and developing units 13 can be arranged around the outer circumferential surface of the drum even when a diameter of the drum is relatively small, and thereby it is possible to make the volume of an apparatus small and compact by the use of a drum with a small diameter of 60 mm through 160 mm.

Arrangement of two each of optics exposure system 12 and two each of developing unit 13 on both sides of a vertical axis of symmetry M—M passing through the center of photoreceptor drum 10 and further arrangement of unit 14A on one side and cleaning unit 19 on the other side of the axis of symmetry as shown in FIG. 19 make the cartridge 30 to be extremely well-balanced laterally so that it may be handled and operated easily.

After confirmation in the present example, it was able to utilize surroundings of a photoreceptor efficiently and to obtain layout well-balanced in terms of outer shape and vertical balance, by arranging the optics exposure system 12 and developing unit 13 at positions at right and left of the vertical line M—M facing each other as shown in the figure, arranging the center of transfer unit 14A at position of angle $\theta_1$ of 5°–40° at upstream side of rotation of photoreceptor drum 10 from the vertical line M—M under horizontal line N—N, arranging the contact point of cleaning unit 19 at position of angle $\theta_2$ of 10°–50° at downstream side of rotation of photoreceptor drum 10 from the vertical line M—M under horizontal line N—N, setting angle $\theta_3$ and $\theta_4$ formed respectively by developing sleeve center lines of a pair of developing units 13 at right and left arranged on the upper portion and horizontal line N—N to be within ±20° vertically and by further setting $\theta_5$ and $\theta_6$ formed by a pair of developing units 13 arranged on the upper portion to be within a range of 45°–75°.

(EXAMPLE 4)

Figure 10:
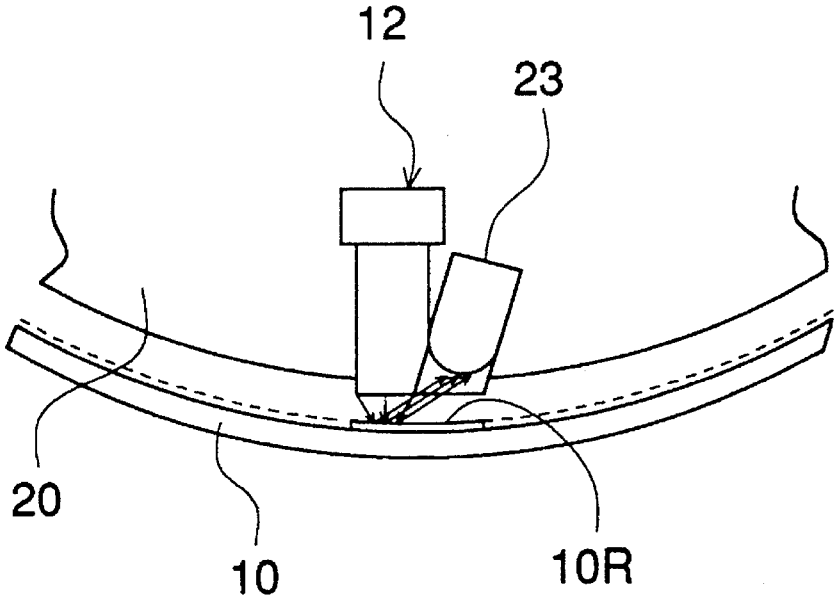
FIG. 10 is a sectional view showing how a light-interceptor of the invention is installed.
Figure 11:
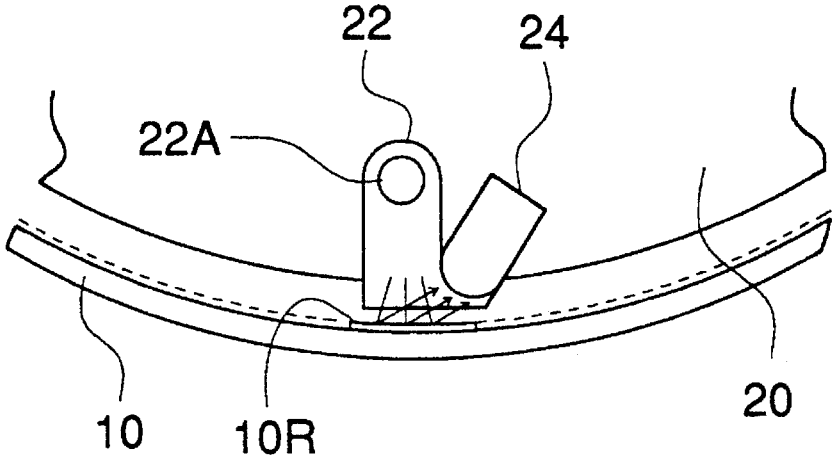
FIG. 11 is a sectional view showing how another light-interceptor of the invention is installed.

FIGS. 10 and 11 represent sectional vies showing the constitution of Example 4. In the FIGS. 23 is a light-interceptor that is a photodetecting means that is provided at the edge of a margin outside an image area of optics exposure system 12 and is composed of a light-intercepting element such as photodiode or phototransistor for detecting light with wavelength of 750 nm or more, 24 is a light-interceptor that is a photodetecting means composed of a light-intercepting element such as photodiode or phototransistor for detecting light with wavelength of 750 nm or more, 22 is an exposure unit for neutralizing provided therein with a lamp such as a fluorescent lamp and LED 22A for neutralizing through uniform exposure before charging or cleaning, and 10R is a white diffusion plate provided inside an image area of the photoreceptor drum 10.

Light-interceptor 23 is installed in a manner that it detects light emitted by optics exposure system 12 at the edge of a margin outside an image area of the optics exposure system 12 and reflected on the diffusion plate 10R, and it sends amount data of light emitted from the optics exposure system 12 to an unillustrated CPU. light-interceptor 24 is installed in a way that it detects reflection light from diffusion plate 10R of exposure unit 22 for neutralizing at the edge of a margin outside an image area of the exposure unit 22 for neutralizing, and it sends amount data of light of the exposure unit 22 for neutralizing to the aforesaid CPU. Based on these data, CPU can adjust light amount of the optics exposure system 12 or the exposure unit 22 for neutralizing. Incidentally, the diffusion plate 10R may also be provided on a part of a margin outside an image area of photoreceptor drum 10 or on the entire circumferential surface as shown with dashed lines.

(EXAMPLE 5)

Figure 9:
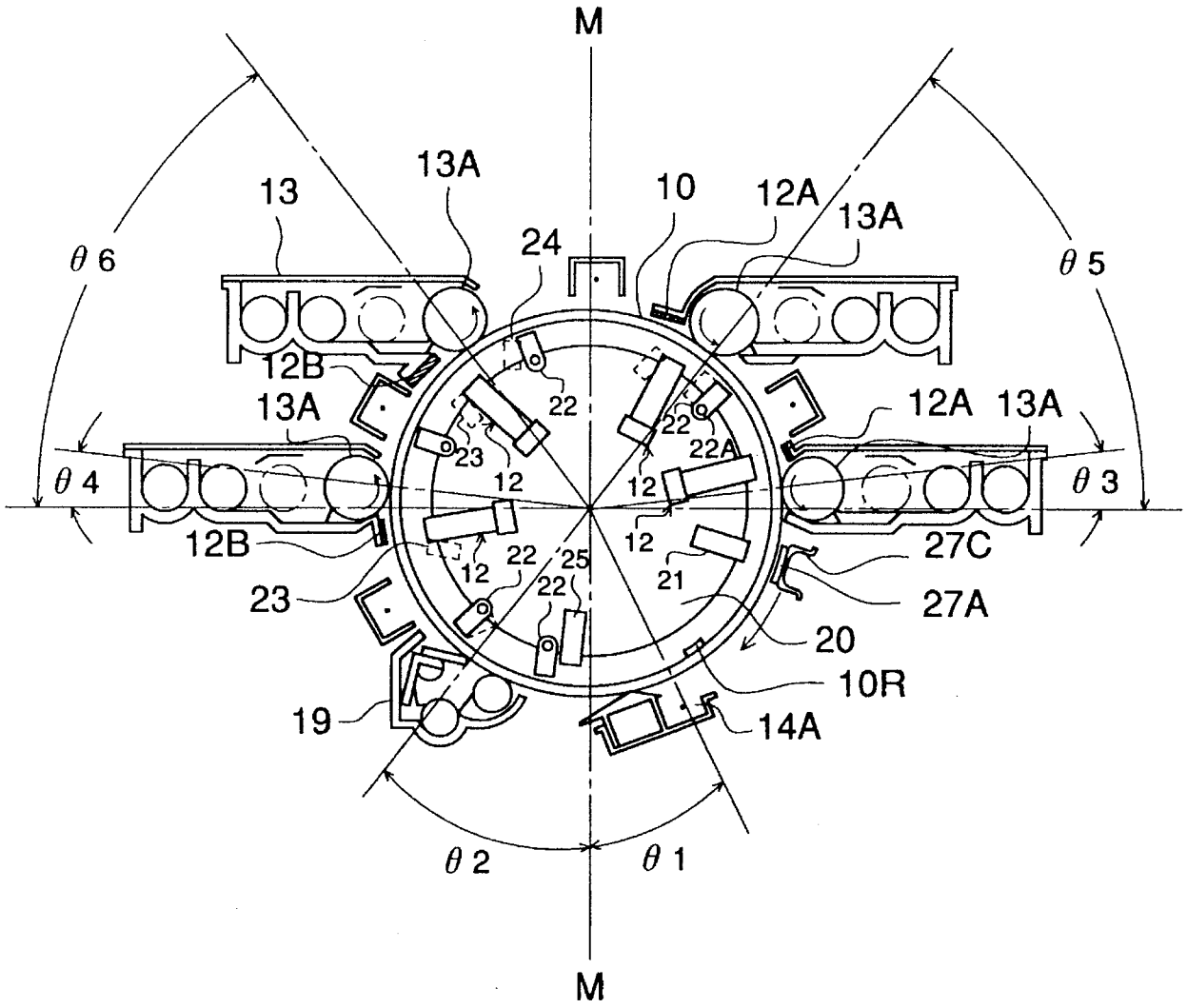
FIG. 9 is a layout diagram showing a layout in a cartridge of the invention.

The numeral 25 in FIG. 9 is a photodetector installed between separating unit 14B and cleaning unit 19, and photodetector 25 is of the same constitution as in the aforesaid photodetector 21 and is installed on supporting member 20 in the same manner as in the photodetector 21. Due to this, how a transfer sheet is running is monitored, when the transfer sheet is not separated completely from the photoreceptor drum 10 causing transfer sheet jam, reflection light is detected, jam signals are sent to an unillustrated CPU, image forming process is stopped, and jam indication is made on an unillustrated display portion. The photodetector 25 naturally requires transmission through an photoreceptor, similarly to the photodetector 21 described in Example 1, and a light-emitting element emitting infrared light with a wavelength of 750 nm or more and a light-intercepting element sensitive to that light can also be used.

Detection of toner images mentioned above can be used for detection of density of a test patch image for toner density correction, for example, or for detection of data for gradation correction.

In the case of density detection for a test patch image for toner density correction, an unillustrated CPU controls, following completion of image forming, so that photoreceptor drum 10 may be charged in the same manner as in the aforementioned image forming and test pattern signals of a patch image for toner density correction may be sent to optics exposure system 12 from an image signal processing section under the condition of no toner on photoreceptor drum 10, and thereby a latent image of a test patch for toner density correction measuring almost 30 mm×20 mm is written on the photoreceptor drum 10 at intervals of 2–5 mm in the subscanning direction. Exposure level in this case is constant, and in the case of pulse width modulation (PWM), for example, exposure is made at the maximum level corresponding to the solid black image. The aforesaid CPU detects the phase of the photoreceptor drum 10 through a method of detecting a reference position stated later, and then drives developing unit 13 for reversal development at the position synchronized with the aforesaid latent image. Density of the test patch image for toner density correction thus developed and visualized is detected when photoreceptor 21 provided at the upstream side of transfer unit 14A intercepts reflection light coming from toner images through irregular reflection, and it is sent to the aforesaid CPU as toner density correction data after being amplified. When the aforesaid test patch image density is lower than the prescribed density, the CPU supplies toner to developing agent D, thereby the developing agent D is maintained constantly at toner density within a prescribed range, and the maximum density of copy images can be corrected to the prescribed density (not less than 1.3). After this, the test patch image passes under the retreated transfer unit 14A and separating unit 14B, and then is cleaned by cleaning unit 19.

After the maximum density of copy images is corrected to be the prescribed density or more, gradation is further corrected in succession.

For gradation correction, an unillustrated CPU controls so that photoreceptor drum 10 may be charged in the same manner as in the aforementioned image forming, and test pattern signals for gradation correction may be sent to optics exposure system 12 from an image signal processing section under the condition of no toner on the photoreceptor drum 10, in the same manner as in the foregoing. With regard to this test pattern, PWM signals which vary stepwise from the lowest level to the highest level are sent intermittently, and thereby latent images 101–10*n* of plural test patches each measuring almost 30 mm×20 mm as shown in FIG. 13 (*a*) are written on the photoreceptor drum 10 at intervals of 2–5 mm in the sub-scanning direction. These latent images are subjected to reversal development made by developing unit 13 to become plural test patch images 101A–10nA for gradation correction having different densities each other shown in FIG. 13 (*b*), which are detected in terms of density by photodetector 21 and then are cleaned by cleaning unit 19 after passing through the position of retreated transfer unit 14A and separating unit 14B. A series of density data thus obtained through detection are sent to the CPU mentioned above as gradation correction data, and thereby gradation supply is conducted.

Detection of the reference position of photoreceptor drum 10 is conducted in the following manner. First, a latent image of fine lines for yellow toner, for example, is formed to be in parallel with a drum shaft by optics exposure system 12(Y), and it is developed and visualized by developing unit 13 (Y). After that, the fine lines are detected by photoreceptor 21, and from timing of that detection, a phase difference from the reference position of the photoreceptor drum 10 is captured. With regard to other optics exposure systems 12 (M)–12 (K), the aforesaid CPU measures phase differences in the same way as in the foregoing, which makes positioning of the optics exposure systems 12 possible.

(EXAMPLE 6)

Figure 14:
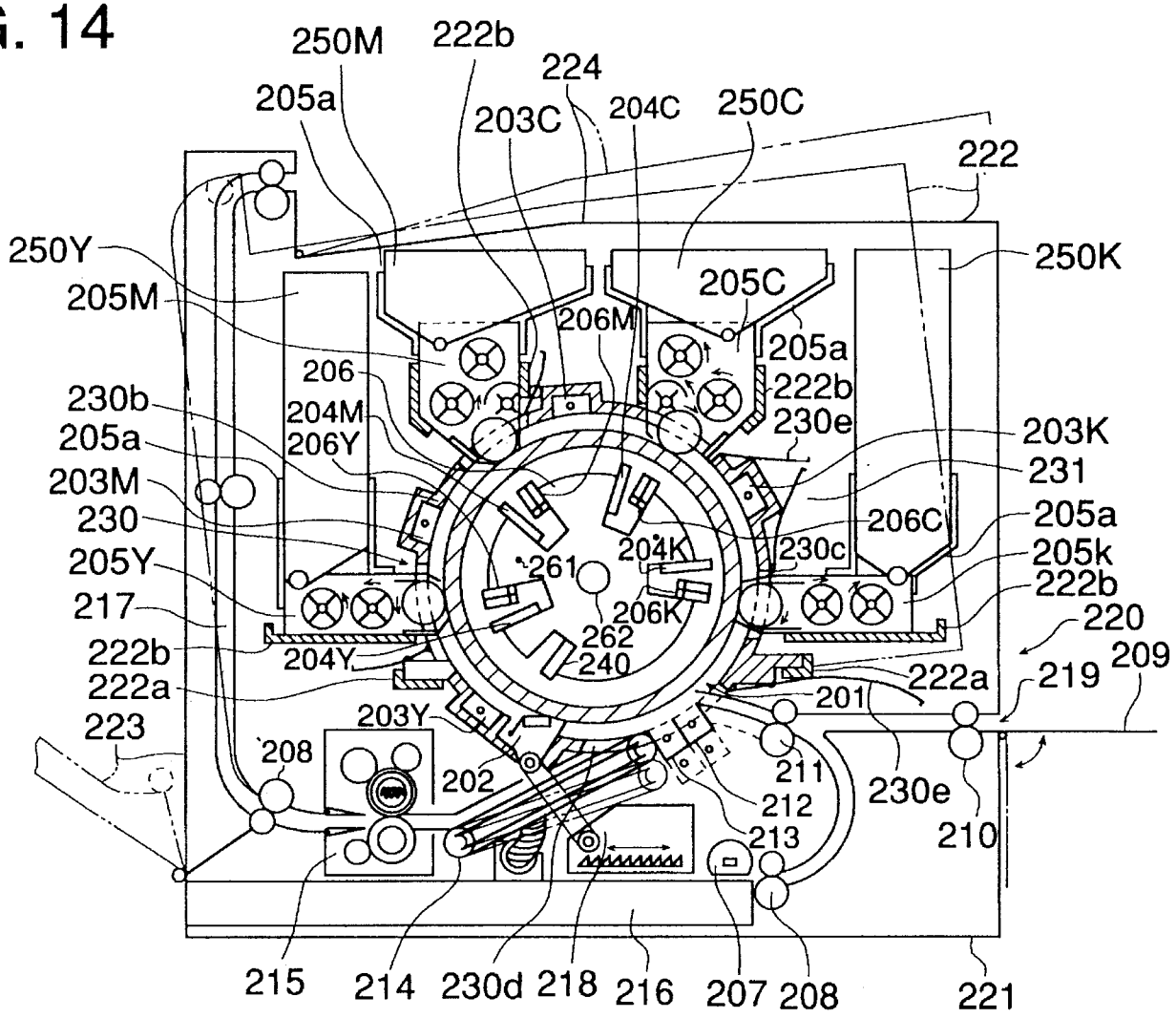
FIG. 14 is a schematic sectional view of constitution showing an example of an image forming apparatus of the sixth example.
Figure 15:
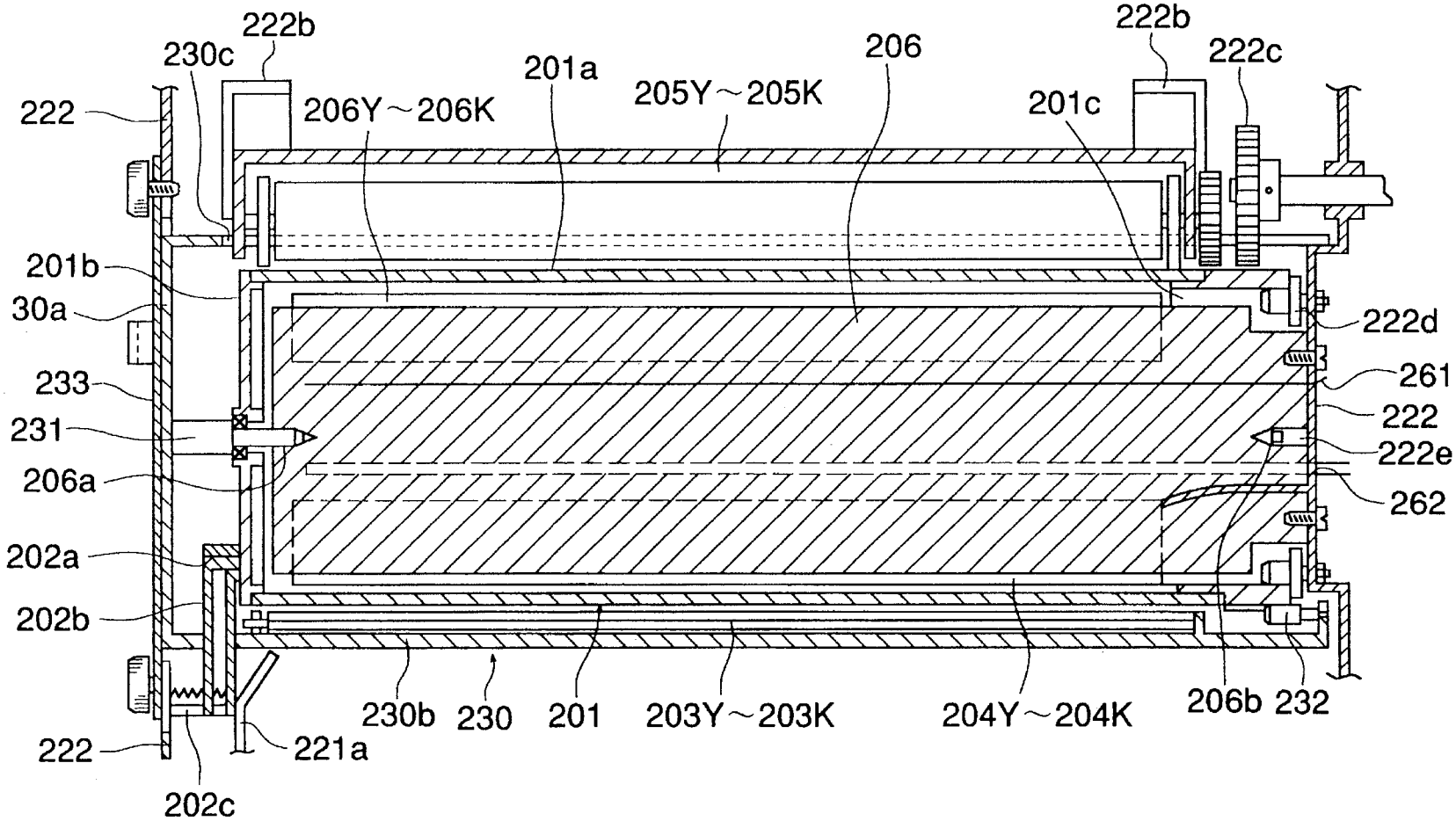
FIG. 15 is a partial section in the axial direction of an photoreceptor in an image forming apparatus showing how members related to image forming in the sixth example are attached.

Each of FIGS. 14 and 15 is a sectional view showing the constitution of Example 6. In the figure, 201 is an photoreceptor, 202 is a cleaner, 240 is a neutralizing lamp, 203 Y–K are charging units, 204 Y–K are imagewise exposure units, 205 Y–K are developing units, 206 is a common supporting member, 261 is a heater, and 262 is a heat pipe. These constituting members are the same as those described in Example 1–Example 5, and explanation for them is omitted accordingly.

There will be explained as follows a method of detecting toner density for forming a color image wherein color balance is excellent stably and image density is sufficient in the present image forming apparatus. On the common supporting member 206, there are provided photodetecting means 206 Y–206K for toner density each consisting of a light-emitting means that emits light toward the surface of each developing roller of developing units 205 Y–205 K and of a light-intercepting means that intercepts reflection light coming from the developing roller surface and obtains toner density information of a developer layer on the developing roller. These photodetecting means 206 Y–206 K detect toner density of the developer layer on the developing roller for each color image forming process with conditions that developing rollers of developing units 205 Y–205 K are rotating and no toner image is formed on the external circumferential surface of photoreceptor 201 positioned between the developing rollers and photodetecting means 206 Y–206 K. Based upon information of that detection, toner supply from replenishing toner containers 250 Y–250 K to the developing units 205 Y–205 K is controlled so that toner density of developers in the developing units 205 Y–205 K may be constant. For the non-contact reversal development made by each of developing units 205 Y–205 K mentioned above, DC developing bias voltage or that to which AC bias voltage is added is impressed on each developing roller from an unillustrated bias power supply in the course of developing. On the other hand, in the course of detecting toner density, the developing roller is made to be in the state that DC component voltage only is impressed thereon, or made to be in the floating state, for stopping development. Due to this, it is possible to detect toner density of a developer layer on the developing roller stably and accurately, and thereby to maintain the toner density of developers in the developing units 205 Y–205 K constant at high accuracy, thus a color image having excellent color balance and sufficient image density can be formed.

For obtaining toner density information at high accuracy, it is preferable that a light-emitting means of photodetecting means 206 Y–206 K emits light to which a photoreceptor of photoreceptor 201 is not sensitive, for example, light having a wavelength similar to that of infrared light. It is further preferable that toner supply control made by a control device is conducted as follows, for example. Namely, the control device controls to start toner supply to developing units 205 Y–205 K when density detected by the photodetecting means 206 Y–206 K is not more than predetermined $T_1$%, and to stop toner supply when density detected by the photodetecting means 206 Y–206 K is not less than predetermined $T_2$% which satisfies $T_1<T_2$. The control device supplies toner forcedly from replenishing toner containers 250 Y–250 K to developing units 205 Y–205 K while prohibiting image forming when density detected by photodetecting means 206 Y–206 K keeps to be not more than predetermined $T_0$% that satisfies $T_1>T_0$ and makes a timer to measure the time of continuation of that state, while when the density does not reach $T_1$ even after $t_1$ of the time of continuation, the control device controls so that display for replacement of the relevant replenishing toner container may be made for replacing replenishing toner containers 250 Y–250 K. Owing to this, replenishing toner containers can be replaced properly without toner level sensors provided in replenishing toner containers 250 Y–250 K, thus sharp color images can be formed stably.

Whether replenishing toner containers 250 Y–250 K have been replaced or not can be judged by detection information from an unillustrated movable sensor that detects movement of developing units 205 Y–205 K from their positions of installation or detects separation of replenishing toner containers 250 Y–250 K from developing units 205 Y–205 K. Thus, forced supply of toner is instructed again by information of replacement of replenishing toner containers 50 Y–250 K, and when detected density of toner exceeds $T_1$ or $T_2$, the detection information cancels the aforesaid command for prohibiting image forming.

Next, there will be explained as follows a method to control developing conditions by detecting the state of developing stably. As a means for photodetecting the state of developing, photodetecting means 206 Y–206 K used for detecting toner density can also be used. Namely, on the common supporting member 206, there are provided photodetecting means 206 Y–206 K each consisting of a light-emitting means that emits light toward the surface of each developing roller of developing units 205 Y–205 K and of a light-intercepting means that intercepts reflection light coming from the developing roller surface and obtains development information at a developing section. These photodetecting means 206 Y–206 K detect density of toner cloud formed at the developing section with conditions that developing rollers of developing units 205 Y–205 K are rotating and a toner image is formed on the external circumferential surface of photoreceptor 201 positioned between the developing rollers and photodetecting means 206 Y–206 K. Based upon information of that detection, DC voltage and AC voltage representing developing bias voltage and their cycles as well as the rotating speed of the developing roller are controlled so that developing characteristics of the developing units 205 Y–205 K may be constant. Incidentally, when detecting density of toner cloud, it is possible to employ either a method to develop a reference latent image formed by imagewise exposure or a method to form toner cloud only without forming a latent image. It is preferable that light-emitting means of photodetecting means 206 Y–206 K emit infrared light to which a photodetector of photoreceptor 201 is not sensitive.

For the following non-contact reversal development for latent images performed by developing units 205 Y–205 K, the aforesaid controlled developing bias voltage is impressed on each developing roller from an unillustrated power supply for bias voltage, or the number of rotations of the developing roller is determined. Thereby, developing characteristics of the developing units 205 Y–205 K can be maintained constant at high accuracy, thus a color image having excellent color balance and sufficient image density can be formed.

As a translucent circumferential wall of photoreceptor 201, a translucent support on which a translucent conductive layer and a photoconductive substance layer are laminated is used. For the translucent support, those formed by various translucent resins such as fluorine, polyester, polycarbonate and polyethyleneterephthalate used for soda glass, Pyrex glass, borosilicate glass and general optical members are used. For the translucent conductive layer, metallic thin films which are composed of indium.tin.oxide (ITO), tin oxide, lead oxide, copper iodide, Au, Ag, Ni and Al and maintain light-transmitting properties are used. For forming those thin films, vacuum deposition methods, active reaction deposition methods, various spattering methods, various CVD methods, dip coating methods and spray coating methods are used. For the photoconductive substance layer, amorphous silicon (a—Si) alloy photoconductive layers, amorphous selenium alloy photoconductive layers and various organic photoconductive layers (OPC) are used.

The illustrated photoreceptor 201 is composed, as shown in detail in FIG. 15, of photoreceptor barrel 201*a* having thereon the aforesaid photoreceptor, mirror member 201*b* that is connected solidly with one end of the photoreceptor barrel 201*a* through press fitting and is engaged with a bearing and of ring gear member 201*c* that is connected solidly with the other end of the photoreceptor barrel 201*a* through press fitting and has gear teeth formed on the outer circumferential portion protruded from the outside diameter of the photoreceptor barrel 201*a*. Namely, the photoreceptor 201 is provided with an open end in which neutralizing lamp 240 arranged on common supporting member 206 whose ring gear member 201*c* side is affixed on upper frame 222, imagewise exposure means 204Y–204K and detecting means 206Y–206K are housed. It is preferable that the outside diameter of such photoreceptor 201 is not less than 70 mm because there need to be arranged on its circumferential surface the sets of charging units 203 Y–203K and developing units 205Y–205K, transfer unit 212, separating unit 213 and cleaner 202, and there need to be arranged in its inside neutralizing lamp 240, imagewise exposure means 204Y–204K and detecting means 206Y–206K.

This photoreceptor 201 is inserted into unit frame 230 through the open end of the unit frame 230 taken out of upper frame 222, namely through the right side in FIG. 15, with the mirror member 201*b* of the photoreceptor 201 taking the lead. In this case, guide pin 231 projected on the inner surface of mirror portion 230*a* of the unit frame 230 and holding mirror member 201*b* is caused to engage, the outer circumferential surface located closer to the tip than the gear portion of the ring gear member 201*c* is put on plural guide rolls 232 provided on the inner flange portion of the open end of the unit frame 230 so that the open end side of the photoreceptor 201 may be supported by the guide rolls 232, thus, the photoreceptor is supported inside the unit frame 230. Preceding this, small-sized and lightweight charging units 203Y–203K and cleaner 202 structured not to collect toner removed from the photoreceptor 201 and thereby to be small-sized and lightweight are installed inside circumferential wall portion 230*b* of the unit frame 230. Plural guide rolls 232 of the unit frame 230 are provided only on the lower half side of the photoreceptor 201 so that they do not interfere the insertion of the photoreceptor 201 into the unit frame 230.

The common supporting member 206 supporting neutralizing lamp 240, imagewise exposure means 204Y–204K and detecting means 206Y–206K is almost a cylinder in shape except a cutout of a mounting seat where imagewise exposure means are fixed through gluing. The common supporting member 206 is provided on its front side that plunges into the photoreceptor 201 with front side center hole 206*a* that engages with guide pin 231 fixed on mirror portion 230*a* of the unit frame 230 and is provided on its opposite side with rear side center hole 206*b* that engages with center pin 222*e* planted on upper frame 222. Owing to this, the positions for mounting imagewise exposure means 204Y–204K and detecting means 206Y–206K on the common supporting member 206 can be arranged easily and accurately through indexing by the use of an index, and imagewise exposure timing that causes no color aberration can be set easily. The common supporting member 206 is then affixed on the upper frame 222 by set screws with rear side center hole 206*b* engaged with center pin 222*e* planted on the upper frame 222. In the case of this affixing, it is naturally preferable for stable and accurate fixation that a positioning pin is also engaged in addition to the center pin 222*e*.

As imagewise exposure means 204Y–204K, a combination of FL, EL, PL and LED arranged in the axial direction of photoreceptor 201 and LISA, PLZT and LCS wherein elements having shutter function are arranged on a line or a combination of line-shaped light source and LISA, PLZT and LCS wherein elements having shutter function are arranged on a line and those composed of a SELFOC lens as a life-size image forming element are preferably used because they are small-sized and suitable to be arranged inside the photoreceptor 201, and those wherein EL array of an end-emission type or LED array and rod lens array are arranged in a housing are used preferably because they have following characteristics. Namely, imagewise exposure means 204Y–204K employing end-emission type element array and rol lens array can be fixed easily through gluing on common supporting member 206 utilizing a flat surface of a housing at high accuracy in terms of image-forming and less amount of out-of-focus because they are structured to be in a shape which is high in linearity on a housing and thereby strong in deformation and they are flat. Further, it is possible to make the pixel size small for dense arrangement and to increase or decrease the number of potentials for gradation easily. Therefore, images which are delicate and have excellent gradation can be formed easily. Accordingly, it is possible to make imagewise exposure means 204Y–204K to be further small and to make the arrangement of plural imagewise exposure means 204Y–204K compact, thereby to make an apparatus small-sized and inexpensive easily, which represents outstanding features.

The unit frame 230 supporting photoreceptor 201 as stated above is engaged with unit frame supporting guide 222*a* provided on upper frame 222 in FIG. 14 from the open end side, and is then fed from the left side in FIG. 15 into the upper frame 222 affixing common supporting member 206 to be mounted by fixing apparatus member 233 combined solidly with mirror portion 230*a* of the unit frame 230 on the upper frame 222 with set screws. For the mounting mentioned above, developing units 205Y–205K are either taken out of the upper frame 222 or retracted to the outside of circumferential wall portion 230*b* of unit frame 230, and for preventing the contact with photoreceptor 201 such as transfer unit 212 in case of need, the transfer unit 212 connected solidly and a conveyance guide as well as separating unit 213 and conveyor 214 are retraction-rotated clockwise around a drive roller shaft of conveyor 214 at the fixing unit side as an axis for rotation, or the upper frame 222 is open-rotated against the lower frame 221, from the state shown with solid lines to the state shown with 2-dot chain lines. In the latter case of open-rotating the upper frame 222, it is preferable for the safe mounting and dismounting of the unit frame 230 that a stopper which maintains the open state is provided. For dismounting the unit frame 230 from the upper frame 222, operations opposite to those for mounting may be used.

When the aforesaid unit frame 230 is mounted, driving gear 222*c* supported on the upper frame 222 engages with a gear of ring gear member 201*c*, roller surfaces of plural photoreceptor supporting rollers 222*d* supported on the upper frame 222 engage with plural portions of the inside diameter of ring gear member 201*c* corresponding to inner circumferential surface of photoreceptor 201, a translucent conductive layer of photoreceptor barrel 201*a* is grounded, a tip portion of guide pin 231 engages with front side center hole 206*a* at the front edge of common supporting member 206, a root flange surface of photoreceptor supporting roller 222*d* comes into contact with the tip surface of ring gear member 201*c*, and an end of a root larger diameter portion of guide pin 231 comes into contact with an outer end of an inner race of a bearing of mirror member 201*b*. Due to the foregoing, the photoreceptor 201 can be mounted on the upper frame 222 with the center of the photoreceptor agreed accurately with that of common supporting member 206. Therefore, relational position between imagewise exposure means 204Y–204K and photoreceptor 201 and relational positions between detecting means 206Y–206K and developing rollers and between developing units 205Y–205K and developing rollers can be determined stably and accurately. Further, when photoreceptor supporting roller 222*d* engages with an inner surface of ring gear member 201*c*, guide rolls 232 which are in contact with an outer circumferential surface of a tip of ring gear member 201*c* leave them slightly. Due to this, the photoreceptor 201 can be rotated by drive gear 222*c* with less resistance.

After the unit frame 230 has been mounted, developing units 205Y–205K are moved toward photoreceptor 201 in a manner that a spacer roller that is coaxial with a developing roller is brought into contact with photoreceptor 201 by developing unit supporting guide 222*b* as shown in FIG. 15, and a gear on the shaft of the developing roller is engaged with a gear of ring gear member 201*c* of photoreceptor 201. When the upper frame 222 is open-rotated or transfer unit 214 is retraction-rotated in advance for mounting the unit frame 230, they are returned to their original state. Thereby, developing units 205Y–205K are driven from the photoreceptor 201 so that arrangement of developing units 205Y–205K may be completed, resulting in the state of an image forming apparatus capable of forming images shown in FIG. 14. Incidentally, in the case where developing units 205Y and 205K move horizontally as in the case of developing units 205Y and 205K in FIG. 14 to come into contact with or to leave photoreceptor 201, it is preferable to provide an unillustrated spring for pressing a developing unit toward photoreceptor 201 on developing unit supporting guide 222*b*, for the purpose to bring a spacer roller into pressure contact with photoreceptor 201 elastically. In the case where a spacer roller comes into pressure contact with photoreceptor 201 by gravity as in the case of developing units 205M and 205C, there is provided a spring that absorbs a part of own weight between a developing unit and developing unit supporting guide 222*b*. In addition, those wherein each of developing units 205Y–205K is driven by an exclusive motor are naturally acceptable, without being limited to an example shown in FIG. 15.

When unit frame 230 is taken out of upper frame 222, viewing window 230*c* for developing units 205Y–205K on circumferential wall portion 230*b* of the unit frame 230 to approach photoreceptor 201 and viewing window 230*d* for transfer unit 214 and separating unit 215 to approach photoreceptor 201 are opened, which makes the photoreceptor 201 to be subjected easily to damage and deterioration. For solving this problem, rotary door 230*e* which makes each of the viewing windows 230*c* and 230*d* to be in the open state when unit frame 230 is mounted on upper frame 222 as shown in FIG. 14 is provided on the edge of each of viewing windows 230*c* and 230*d* on circumferential wall portion 230*b* of unit frame 230 so that viewing windows 230*c* and 230*d* may be closed when the unit frame 230 is taken out of the upper frame 222. With regard to this rotary door 230*e*, unit frame 230 is mounted or dismounted when the rotary door is opened. Therefore, it is preferable, from the view-point of safe mounting or dismounting of unit frame 230, that the rotary door is urged by a spring so that the rotary door may take its constant open state as shown in FIG. 14 when its engagement with a stopper under its closed state is released.

Cleaner 202 incorporated in unit frame 230 of an example shown in FIG. 14 makes an apparatus small in size by employing the constitution wherein toner scraped from photoreceptor 201 by a scraper blade or the like is fed out of the side wall by conveyance screw 202*a* and then is dropped, through chute pipe 202*b*, on the portion of waste toner container 218 arranged on the lower frame 221 side. Therefore, when the unit frame 230 is drawn out of the upper frame 222, the chute pipe 202*b* is disconnected from a toner-receiving pipe of the waste toner container 218, allowing toner to spill from the chute pipe 202*b*. For preventing this, slide cap 202*c* that is urged by a spring to move to the position for closing the chute pipe 222*b* is provided on the bottom of the chute pipe 202*b*. When the unit frame 230 is mounted on the upper frame 222, this slide cap 202*c* is pushed by cam 221*a* provided on lower frame 221 to move to the position for opening the chute pipe 202*b* against an urge of the spring. When trying to draw the unit frame 230 out of the upper frame 222, the slide cap 202*c* is urged by a spring to move to the position for closing the chute pipe 202*b*. Even when the upper frame 222 is opened from the lower frame 221 for clearing a jammed transfer sheet the cam 221*a* releases the slide cap 202*c* from being pushed to close the chute pipe 202*b* for preventing toner spilling.

Incidentally, conveyance screw 202*a* of cleaner 202 may either be rotated through transmission from rotation of photoreceptor 201 or be rotated by a motor as in the case where a scraper blade is brought into contact with or separated from photoreceptor 201 by an electromagnet.

Toner dropped from cleaner 202 through chute pipe 202*b* is collected in waste toner container 218 by a conveyance screw of the waste toner container 218. On the bottom of the waste toner container 218, there is provided a reciprocating conveyance plate that moves collected toner to the rear side. When the waste toner container 218 is filled up with toner, the unit frame 230 is taken out of the upper frame 222 and the waste toner container 218 is taken out of an apparatus to throw toner in the waste toner container 218 away. Therefore, when necessary, it is also possible to employ the constitution wherein transfer unit 212 connected solidly can be rotated counterclockwise around a drive roller shaft at a fixing unit side of conveyor 214. Whether the waste toner container 218 is filled up with toner or not can be detected by conventional known methods such as a pressure detecting sensor provided inside to detect the pressure caused by toner or that provided outside to detect a weight of the waste toner container 218.

The sixth example has been explained referring to illustrations. However, an image forming apparatus of the present example is not limited to those wherein 4 sets of charging units, imagewise exposure means and developing units are provided, but it may also be one wherein only one set of a charging unit and an imagewise exposure means is provided and plural toner images made through plural rotations of an photoreceptor are superposed to form a color image, or one wherein only one set of a charging unit, an imagewise exposure means, a developing unit an optical toner density detection means is provided, and a monochromatic image only is formed on an photoreceptor.

As stated above, the first example has the following effects. A detection means of various kinds of information, such as toner density of developer layer, developing condition, and others, is provided inside the image forming body, which includes a photoreceptor provided on a transparent base, so that light is irradiated from the detection means toward a developing roller surface of a developer outside the image forming body and the reflection of the light is detected by the detection means to obtain the information. Therefore, information error and deterioration of the detection means can be prevented, and information such as correct toner density and developing condition can be stablly obtained. In a color image forming apparatus of a type having plural imagewise exposure means inside a drum-shaped photoreceptor, that toner images and others can be detected accurately through the photoreceptor because a light-emitting element that emits light with a wavelength having a high transmission factor for the aforesaid photoreceptor and for toner images thereon is used in a photodetecting means, and that occurrence of unwanted light and contamination by toner are prevented for realization of photodetecting at high accuracy because a light-absorbing member or an electrode member having light-absorbing property is arranged at the location facing the photodetecting means and voltage with a polarity opposite to that of toner is impressed.

In the third example, the aforesaid photodetecting means is installed together with the aforesaid exposure means on the same supporting member, resulting in the constitution allowing installation at high accuracy in terms of dimensions. Accordingly, an apparatus can be made small and photodetecting at high accuracy is made possible to provide a color image forming apparatus having an effect that extremely sharp images can be obtained.

Further, in the sixth example, there is provided inside an photoreceptor composed of a translucent base and a photoreceptor provided thereon a detecting means that detects toner density of a developer layer and developing state by emitting light transmitted through an photoreceptor toward the developing roller surface of a developing unit located at outer side and by receiving reflection light. Therefore, problems that toner density information and developing information are not accurate because developer touches a detecting means or a life of a detecting means is short are not caused, and it is possible to obtain stable and accurate toner density information and developing information based on which the toner supply to developing units and developing conditions are controlled, which makes it possible to maintain image quality constant.

What is claimed is:

1. A color image forming apparatus, comprising:

a photoreceptor for forming a toner image;

a charging means for charging said photoreceptor;

an imagewise exposure means, accommodated inside said photoreceptor, for imagewisely exposing said photoreceptor with exposure light so as to form a latent image on said photoreceptor;

a developing means for developing said latent image with toner so as to form a toner image on said photoreceptor;

wherein a process of forming said toner image is repeated for a plurality of times so that a plurality of toner images are superimposed to from a composite toner image;

a transfer means for transferring said composite toner image onto a recording medium; and a photodetecting means, accommodated inside said photoreceptor, for detecting light from said photoreceptor.

2. The apparatus of claim 1, wherein said light has a high transmission factor for said photoreceptor.

3. The apparatus of claim 1, wherein a wavelength of said light is not less than 750 nm.

4. The apparatus of claim 1, wherein said developing means develops said latent image with black toner, and said black toner has a high transmission factor for said light a wavelength of which is not less than 750 nm.

5. The apparatus of claim 1, further comprising:

a light-absorbing member for absorbing said exposure light wherein said light-absorbing member is provided on an outer circumferential surface of said photoreceptor which faces said photodetecting means.

6. The apparatus of claim 1, further comprising:

an electrode member for which is provided facing said photodetecting means;

wherein a voltage impressed on said electrode member has a same polarity as that of said toner, said developing means includes a developing sleeve from which said toner is transferred to said photoreceptor, and an absolute value of said voltage is greater than those of charging by said charging means and said developing sleeve.

7. The apparatus of claim 1, further comprising:

a supporting means for supporting said imagewise exposure means and said photodetecting means inside said photoreceptor.

8. The apparatus of claim 7, further comprising:

a process cartridge for enclosing at least said photoreceptor, said image wise exposure means, said photodetecting means, and said supporting means wherein said process cartridge is provided detachable from said apparatus.

9. The apparatus of claim 1, wherein said photodetecting means is for detecting said tone image formed on said photoreceptor.

10. The apparatus of claim 1, wherein said photodetecting means is for detecting said recording medium.

11. The apparatus of claim 1, wherein said photodetecting means is for detecting a reference position of said photoreceptor.

12. The apparatus of claim 1, wherein said photodetecting means is for detecting a light amount of an imagewise exposure by said image wise exposure means.

13. The apparatus of claim 1, further comprising:

an exposure means for neutralizing a charge on said photoreceptor by a neutralizing exposure of light;

wherein said photodetecting means is for detecting a light amount of said neutralizing exposure.

14. The apparatus of claim 1, wherein said developing means includes a developing roller from which said toner is transferred to said photoreceptor; and said photodetecting means includes:

a light emitting means, accommodated inside said photoreceptor, for emitting light, having a high transmission factor for said photoreceptor, onto said developing roller;

wherein said photodetecting means detects reflection light of said light emitted from said emitting means and reflected from said toner image on said photoreceptor.

15. The apparatus of claim 1, wherein said developing means includes a developing roller from which said toner is transferred to said photoreceptor; and said photodetecting means includes:

a light emitting means, accommodated inside said photoreceptor, for emitting light, having a high transmission factor for said photoreceptor, onto said developing roller;

wherein said photodetecting means detects reflection light of said light emitted from said emitting means and reflected from said developing roller so as to determine a toner density of said toner on said developing roller; and a control means for controlling a toner amount to be supplied to said developing means according to said toner density.

16. The apparatus of claim 15, comprising:

a plurality of developing means each for developing said latent image with a respective color toner so as to form a respective component color toner image on said photoreceptor;

a plurality of photodetecting means each for detecting a toner density of said respective component color toner image formed by respective one of said plurality of developing means.

17. The apparatus of claim 16, comprising:

a plurality of imagewise exposure means, accommodated inside said photoreceptor, each for imagewisely exposing said photoreceptor with exposure light so as to form a respective latent image of each component color of a color image on said photoreceptor;

wherein said composite toner image is formed by superimposing a predetermined number of component color toner images, and superimposition of all of said predetermined number of component color toner images is started within one rotation of said photoreceptor.

18. The apparatus of claim 15, further comprising:

a supporting means for supporting said imagewise exposure means and said photodetecting means inside said photoreceptor.

19. The apparatus of claim 15, wherein said photoreceptor is not receptive of said light emitted from said light emitting means.

20. The apparatus of claim 15, wherein said photodetecting means determines said toner density of said toner while said developing roller is rotating but said developing means is not developing said latent image with toner.

21. The apparatus of claim 1, wherein said developing means includes a developing roller from which said toner is transferred to said photoreceptor; and said photodetecting means includes:

a light emitting means, accommodated inside said photoreceptor, for emitting light, having a high transmission factor for said photoreceptor, onto said developing roller;

wherein said photodetecting means detects reflection light of said light emitted from said emitting means and reflected from said developing roller so as to determine developing information of a developing area in a vicinity of said developing roller; and a control means for controlling said developing condition of said developing means according to said developing information.

22. The apparatus of claim 21, comprising:

a plurality of developing means each for developing said latent image with a respective color toner so as to form a respective component color toner image on said photoreceptor;

a plurality of photodetecting means each for detecting a toner density of said respective component color toner image formed by respective one of said plurality of developing means.

23. The apparatus of claim 21, comprising:

a plurality of imagewise exposure means, accommodated inside said photoreceptor, each for imagewisely exposing said photoreceptor with exposure light so as to form a respective latent image of each component color of a color image on said photoreceptor;

wherein said composite toner image is formed by superimposing a predetermined number of component color toner images, and superimposition of all of said predetermined number of component color toner images is started within one rotation of said photoreceptor.

24. The apparatus of claim 21, further comprising:

a supporting means for supporting said imagewise exposure means and said photodetecting means inside said photoreceptor.

25. The apparatus of claim 21, wherein said photoreceptor is not receptive of said light emitted from said light emitting means.

26. The apparatus of claim 21, wherein said photodetecting means determines said developing information of said developing area while said developing roller is rotating and said toner is flown on an outer surface of said photoreceptor between said developing roller and said photodetecting means.

* * * * *